United States Patent [19]

Shimoyama

[11] 4,410,299

[45] Oct. 18, 1983

[54] COMPRESSOR HAVING FUNCTIONS OF DISCHARGE INTERRUPTION AND DISCHARGE CONTROL OF PRESSURIZED GAS

[75] Inventor: Konoshuke Shimoyama, Kiryu, Japan

[73] Assignee: Ogura Glutch Co., Ltd., Kiryu, Japan

[21] Appl. No.: 222,154

[22] Filed: Jan. 2, 1981

[30] Foreign Application Priority Data

Jan. 16, 1980 [JP] Japan ..... 55-003404

[51] Int. Cl.[3] ..... F04B 23/00

[52] U.S. Cl. ..... 417/440; 417/519; 418/61 A

[58] Field of Search ..... 417/440, 519; 418/61 A

[56] References Cited

U.S. PATENT DOCUMENTS 1,508,806 9/1924 Silvestri ..... 417/519
3,628,899 12/1971 George ..... 418/61 A
3,762,840 10/1973 Merz ..... 418/61 A
3,762,842 10/1973 George, Jr. ..... 418/61 A

*Primary Examiner*—William A. Cuchlinski, Jr.
*Assistant Examiner*—E. Rollins Cross
*Attorney, Agent, or Firm*—Frishauf, Holtz, Goodman & Woodward

[57] ABSTRACT

A compressor is provided which has a housing formed with a volume control chamber located in the vicinity of the discharge port and within which a valve is mounted, a first port communicating the volume control chamber with a pumping chamber defined within the housing, and a second port communicating the volume control chamber with the suction port. The valve is disposed so as to open selectively the first port alone or both the first port and the second port, to thereby make it possible to control the discharge rate of pressurized gas or interrupt discharge of same without interruption of driving of the gas pressurizing member of the compressor for compression of gas such as a rotor or a piston.

6 Claims, 10 Drawing Figures

COMPRESSOR HAVING FUNCTIONS OF DISCHARGE INTERRUPTION AND DISCHARGE CONTROL OF PRESSURIZED GAS

BACKGROUND OF THE INVENTION

This invention relates to compressors for use in air conditioning systems for automotive vehicles, and more particularly to compressors which themselves are capable of interrupting discharge of pressurized gas and controlling the discharge rate of same.

Compressors for use in air conditioning systems for automotive vehicles or like systems generally include rotary compressors and reciprocating compressors. In these compressors, transmission of torque from a driver to the compressor is carried out by means of a pulley or a gear which is mounted on the main shaft of the compressor for rotating the rotor in the case of a rotary compressor or on the crank-shaft connected to the piston in the case of a reciprocating compressor. A clutch is provided between the driver and the main shaft of the compressor or the crank-shaft, which operates to permit or interrupt transmission of torque from the driver to the compressor, to make it possible to interrupt the operation of the compressor whenever discharge of pressurized gas is not required.

This clutch usually comprises a magnetic clutch which is arranged for engagement or disengagement in response to the action of a thermostat which is arranged to detect the compartment temperature.

A compressor having the above arrangement, when used in an air conditioning system for automotive vehicles, is mounted within the engine room of the vehicle and is driven by part of the output of the engine in such a manner that torque is transmitted from the engine to the input pulley of the magnetic clutch by means of a belt connected between the above input pulley and a pulley mounted on the crank-shaft of the engine.

However, the conventional compressors, which are provided with magnetic clutches for torque transmission to the compressor and interruption of same, have the disadvantage that the engine undergoes an increased load due to the facts that the diameter of the input pulley of the magnetic clutch cannot be designed moderately small owing to the structural limitation of the magnetic clutch and the weight of the magnetic clutch is considerably large.

Further, in air conditioning systems in general, when there is an increase in the rotational speed of the compressor during normal operation, the compressing capacity of the compressor increases in direct proportion to the increase of the rotational speed of the compressor. However, most of the currently used air conditioning systems for use in automotive vehicles have a maximum refrigerating capacity of approximately 3,000 kcal/H. Therefore, even though the compressor has its compressing capacity increased with the increase of the rotational speed of the compressor, the air conditioning system cannot exhibit a refrigerating capacity of a calorific value exceeding the above value. Therefore, it is necessary to restrain an increase in the refrigerating capacity of the compressor when the compressor speed has exceeded a certain level, to ensure a long effective life of the air conditioning system.

OBJECT AND SUMMARY OF THE INVENTION

It is therefore the object of the invention to provide a compressor of a novel construction which is capable per se of interrupting its pressurized gas discharge action even when the gas pressurizing member such as a rotor or a piston continues to be driven, to thereby dispense with the use of the magnetic clutch, and also is capable per se of controlling the flow rate of pressurized gas being discharged through a change in the compression volume even during engagement of the magnetic clutch to thereby obtain a decrease in the load applied to the driver.

According to the invention, a compressor is provided which comprises: a housing formed with an internal space, a suction port and a discharge port; and a gas pressuring member movably received within the internal space, wherein during movement the gas pressurizing member has at least part of its surfaces cooperating with inner wall surfaces of the internal space to define a pumping chamber in which the suction port and the discharge port open, wherein the housing is further formed therein with a volume control chamber located in the vicinity of the discharge port, a first port communicating the volume control chamber with the pumping chamber, and a second port communicating the volume control chamber with the suction port. A valve is mounted within the volume control chamber, which is disposed to close both the first port and the second port at its first position, open the first port and close the second port at its second position, and open both the first port and the second port at its third position.

The above and other objects, features and advantages of the invention will be more apparent from the ensuing description taken in connection with the accompanying drawings, in which:

DETAILED DESCRIPTION

Figure 1:
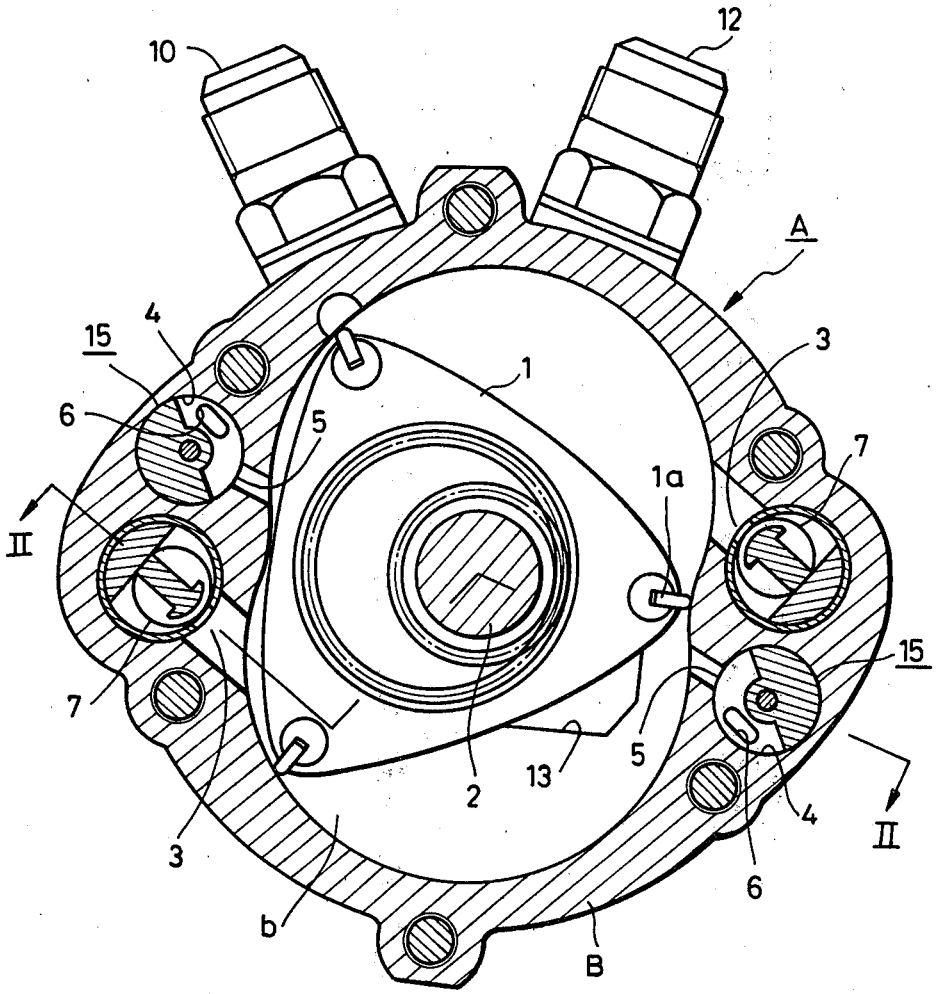
FIG. 1 is a transverse sectional view of a compressor according to an embodiment of the invention.

Referring now to the drawings, there are illustrated compressors according to embodiments of the invention.

FIG. 1 illustrates a rotary commpressor A of the epitrochoidal type according to a first embodiment of the invention.

As well known, this rotary compressor comprises a rotor housing B within which is defined a chamber b having an inner peripheral surface configurated in epitrochoids having two nodes, and a rotor 1 having an outer peripheral surface configurated in an envelope corresponding to the epitrochoidal inner peripheral surfaces of the chamber and received within the chamber b. The rotor 1 is rotatably supported on the main shaft 2 of the compressor which is connected to a driver, not shown, for rotation in a predetermined circumferential direction. During rotation of the main shaft 2, the rotor 1 is rotated with a plurality of sealing members 1*a* mounted on the rotor at its vertices for radial movement sliding over the inner peripheral surface of the chamber b to cause changes in the volumes of pumping chambers which are defined by the rotor 1, the sealing members 1*a* and the inner peripheral surface of the chamber b, to repeatedly execute the strokes of suction, compression and discharge of gas.

In the rotary compressor in FIG. 1, the rotor housing B is formed therein with discharge ports 3, 3 opening in the chamber b, and volume control chambers 4,, 4 in the form of cylindrical cavities which extend axially of the compressor A at a location in the vicinity of the respective discharge ports 3,3.

First ports 5 are formed in the peripheral wall B′ of the rotor housing B and opens in the chamber b, and second ports 6 are formed in a side wall B″ of the rotor housing B in communication with a lower pressure zone communicating with a suction port, not shown. Both the first ports 5 and the second ports 6 communicate with the respective volume control chambers 4,4.

Figure 2:
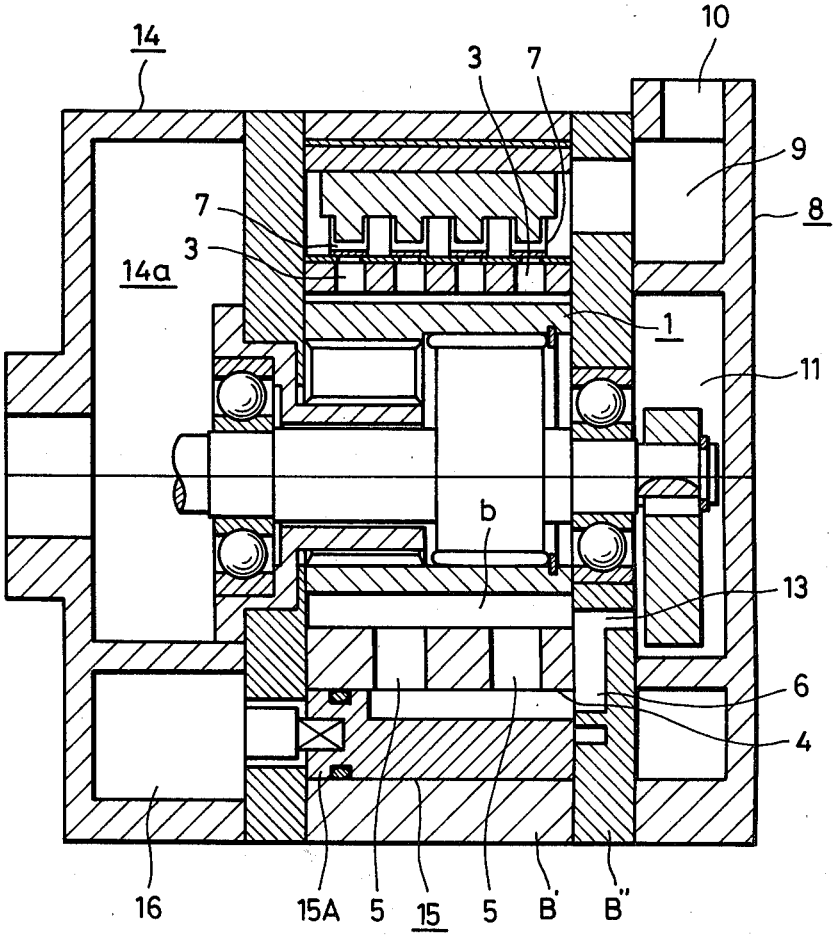
FIG. 2 is a sectional view taken on line II—II in FIG. 1.

FIG. 2 illustrates in section a portion of the compressor of FIG. 1 including the discharge ports 3 and seen in the upper half portion and another portion of the compressor including one of the volume control chambers 4 and seen in the lower half portion, respectively. The discharge ports 3 communicate with an outlet connector 10 formed in a rear casing 8 via an annular high pressure chamber 9 formed in the same casing 8. In the illustrated position, the discharge ports 3 are closed by their respective reed valves 7.

On the other hand, the volume control chambers 4,4 communicate with a low pressure chamber 11 formed at a central portion of the rear casing 8 via their respective second ports 6. The low pressure chamber 11 communicates with an inlet connector 12 (FIG. 1) formed in the rear casing 8 as well as with the chamber b and the second ports 6 via through bores 13 formed through the side wall B″ of the rotor housing B.

Also a space 14*a* formed within the front casing 14 commmunicates with the inlet connector 12 via a through bore, not shown.

Figure 5:
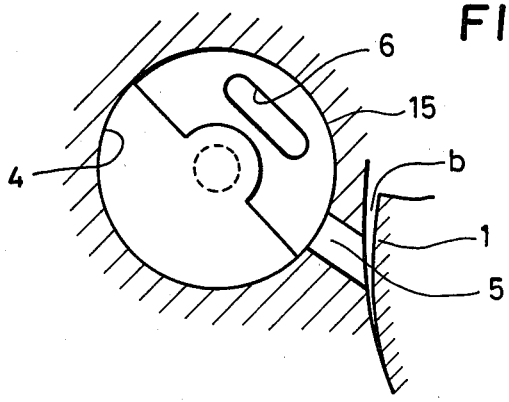
FIG. 5 is a view similar to FIG. 3 showing the rotary valve in the position for interrupting the compression action.
Figure 6:
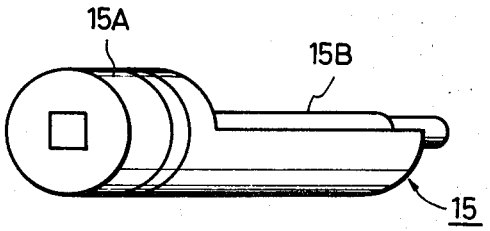
FIG. 6 is a perspective view of the rotary valve.

A rotary valve 15 is pivotally mounted within the volume control chamber 4, which, as shown in FIG. 6, comprises a base portion 15A having a circular cross section formed at one end, and a semi-circular portion 15B having a semi-circular cross section extending from an intermediate portion to the other end. The rotary valve 15 is coupled at its base portion 15A to a rotary solenoid 16 mounted within the front casing 14 so that it can be rotated by means of the solenoid 16 to be set at a plurality of predetermined positions, that is, the positions shown in FIGS. 3, 4 and 5.

Figure 3:
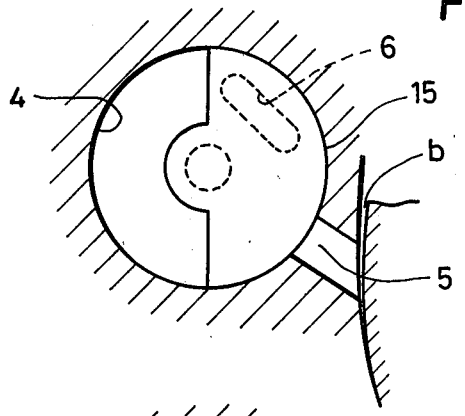
FIG. 3 is a sectional fragmentary view, on an enlarged scale, of the rotary valve in FIGS. 1 and 2, which is in the position for normal compression action.

In the position illustrated in FIG. 3, the first ports 5 are closed by an outer peripheral surface of the rotary valve 15 and the second port 6 by an end surface of the same valve, respectively, so that the volume control chamber 4 is shut off from both the chamber b and the low pressure chamber 11.

With this valve position, when the rotor 1 is rotated, normal gas compression action takes place, wherein compressed gas within the pumping chamber urges the reed valves 7 to open same and is discharged therethrough.

Figure 4:
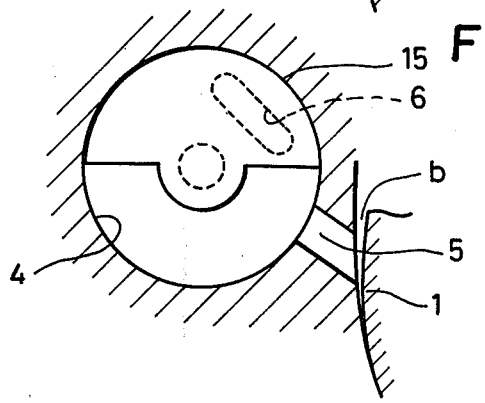
FIG. 4 is a view similar to FIG. 3, showing the rotary valve in the position for increasing the volume.

In the position illustrated in FIG. 4, the rotary valve 15 closes the second port 6 and opens the first ports 5 alone. During the compression stroke of the pumping chamber due to the rotation of the rotor 1, the pumping chamber has a compression volume substantially increased by an amount corresponding to the space within the volume control chamber 4. Therefore, the compression ratio is reduced, resulting in a reduction in the discharge of pressurized gas.

In the position illustrated in FIG. 5, the rotary valve 15 opens both the first ports 5 and the second port 6. No compression action takes place, resulting in no discharge of gas, since gas sucked into the pumping chamber is returned to the low pressure chamber 11 via the first ports 5, the volume control chamber 4 and the second port 6 when the pumping chamber is on the volume reduction stroke due to the rotation of the rotor 1. This situation that there occurs no discharge of gas in spite of the rotation of the rotor 1 is substantially identical with a situation that transmission of input to the compressor for rotating the rotor 1 is interrupted.

The present invention having the above-described arrangement can be practiced in such a manner that the angular position of the rotary valve 15 is controlled as a function of a variation in the compartment temperature or as a function of variations in the compartment temperature, the vehicle speed, etc. when applied to a compressor for air conditioning systems for automotive vehicles, so as to open the first ports 5 along or both the first ports 5 and the second port 6, which permits changeover between gas discharge control and gas discharge interruption even when rotation of the main shaft 2 of the compressor is continued. Thus, the use of a magnetic clutch can be dispensed with.

Figure 7:
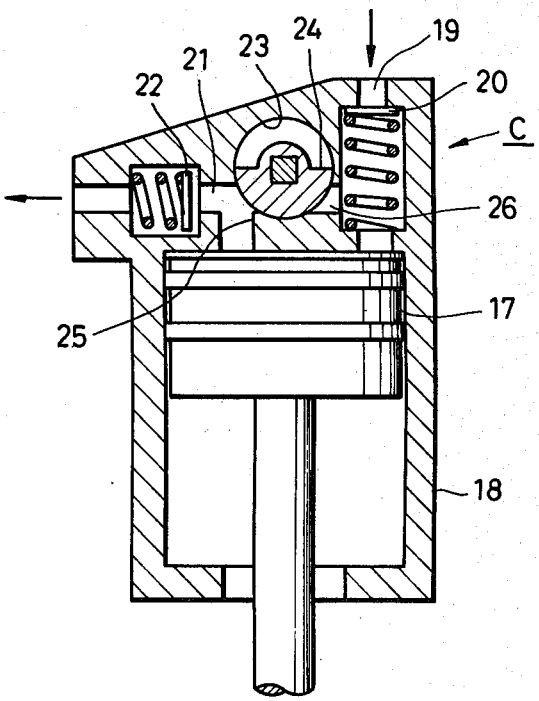
FIG. 7 is a longitudinal sectional view of a compressor according to a further embodiment of the invention.

FIG. 7 illustrates a second embodiment according to the invention. In this embodiment, the invention is applied to a reciprocating compressor C. A piston 17 is connected to the crank-shaft of an engine, not shown, for instance, for reciprocating motion within the cylinder 18 in unison with the rotation of the crank-shaft. Formed in the head of the cylinder 18 are a suction port 19 and a discharge port 21 which both communicate with the cylinder bore within the cylinder 18 via a suction valve 20 and a discharge valve 22, respectively. As the piston 17 moves downward, gas is sucked into the cylinder bore through the suction port 19 and the suction valve 20, while as the piston 17 moves upward, suction gas within the cylinder bore is compressed by the piston to open the discharge valve 22 and is discharged through the valve 22 and the discharge port 21. Also formed within the head of the cylnder 18 is a volume control chamber 23 which communicates with the cylinder bore via a first port 25 and with the suction port 19 via a second port 26, respectively. Mounted within this volume control chamber 23 is a rotary valve 24 which has a configuration identical with the rotary valve 15 illustrated in FIG. 6. This rotary valve 24 is rotatively controlled so as to close both the first port 25 and the second port 26 both opening in the volume control chamber 23, open either one of them, or open both of them, as in the first embodiment previously described.

Figure 8:
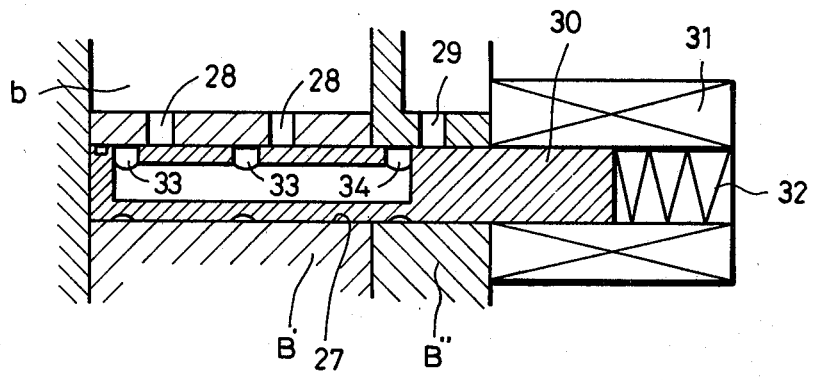
FIG. 8 is a sectional view of essential part of a compressor according to another embodiment of the invention, showing a spool valve in the position for normal compression action.
Figure 9:
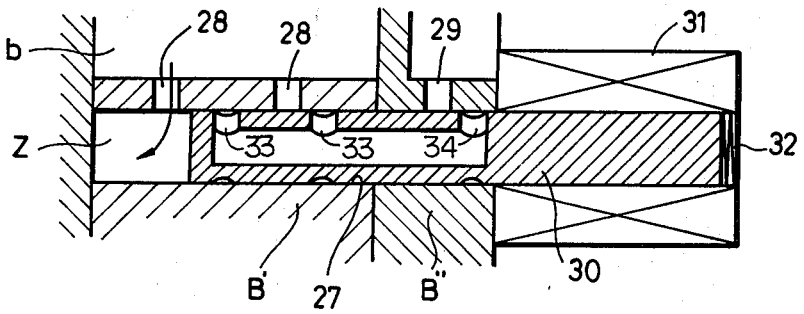
FIG. 9 is a view similar to FIG. 8, showing the spool valve in the position for increasing the compression volume.
Figure 10:
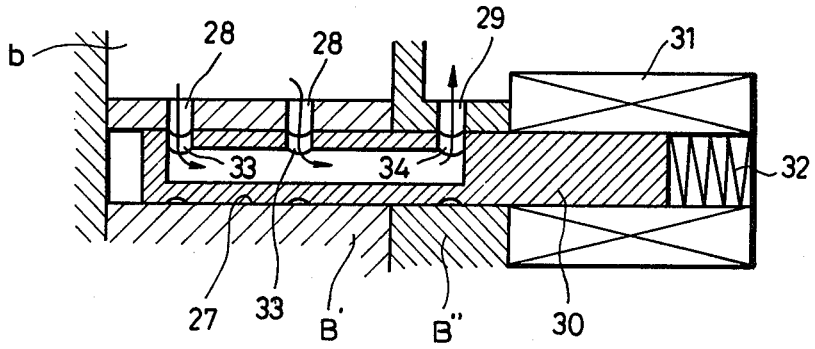
FIG. 10 is a view similar to FIG. 8, showing the spool valve in the position for interrupting the compression action.

FIGS. 8 through 10 illustrate another embodiment of the invention which is applied to a rotary compressor and in which a spool valve is used in place of the rotary valves 15, 24. The compressor according to this embodiment has the same construction as that illustrated in FIGS. 1 and 2, except for the portion illustrated in FIGS. 8 through 10. A volume control chamber 27 is formed in the rotary housing B, which extends through the peripheral wall B′ and a side wall B″ and communicates with the chamber b and the low pressure chamber, not shown, through first ports 28, 28 and a second port 29 formed, respectively, in the peripheral wall B′ and the side wall B″. This volume control chamber 27 houses a spool valve 30 slidably received therein. The spool valve 30 can be displaced rightward against the force of a spring 32 by the action of a solenoid 31 provided around one end portion of the valve 30. The other end portion of the spool valve 30 is formed as a hollow portion and has a peripheral wall formed with through bores 33, 33, 34 which are axially spaced from each other at intervals corresponding to those between the first and second ports 28, 28, 29.

In the position in FIG. 8, the solenoid 31 is in a deenergized state with the spool valve 30 displaced to its leftmost position by the force of the spring 32 to close all of the first ports 28, 28 and the second port 29. This position corresponds to the position of FIG. 3, wherein normal compression takes place so that pressurized gas within the pumping chamber is discharged through reed valves, not shown, which are similar to the reed valves 7 illustrated in FIGS. 1 and 2.

In the position in FIG. 9, the solenoid 31 is in an energized state with the spool valve 30 displaced to its rightmost position against the force of the spring 32, wherein one of the first ports 28, 28 is in communication with the volume control chamber 27. With this position, the pumping chamber, when on the compression stroke, has a compression volume substantially increased by an amount corresponding to the volume within the space z defined between the volume control chamber 27 and an end face of the spool valve 30, resulting in a reduction in the compression ratio and a corresponding reduction in the discharge of pressurized gas.

In the position in FIG. 10, the spool valve 30 is biased to an intermediate position by the solenoid 31 which is then energized with a relatively small amount of electric current, wherein the first ports 28, 28 and the second port 29 are in engagement with the through bores 33, 33 and 34, respectively. With this position, when the pumping chamber is on the compression stroke, the gas within the pumping chamber flows into the low pressure chamber through the first ports 28, 28, the through bores 33, 33 and the interior of the spool valve 30, the through bore 34 and the second port 29, as indicated by the arrows, so that no compression action takes place, with no dischargd of gas.

As is learned from the above description, according to the compressor of the invention, gas discharge can be controlled or interrupted without interrupting driving of its gas pressurizing member for compression action which comprises a rotor rotatably supported on the main shaft of the compressor in the case of a rotary compressor or a piston coupled to a crank-shaft in the case of a reciprocating compressor. Therefore, if the compressor is used in an air conditioning system for automotive vehicles, the vehicle engine can undergo much lesser load.

Obviously many modifications and variations of the present invention are possible in the light of the above teachings. It is therefore to be understood that within the scope of the appended claims in the invention may be practiced otherwise than as specifically described.

What is claimed is:

1. In a compressor including a housing formed therein with an internal space, a suction port and a discharge port; and a gas pressurizing member movably received within said internal space of said housing, wherein during moving said gas pressurizing member has at least part of surfaces thereof cooperating with inner wall surfaces of said internal space to define a pumping chamber in which said suction port and said discharge port open, the improvement wherein said housing further comprises:

at least one volume control chamber having a substantial internal volume relative to the internal volume of said pumping chamber in said internal space of said housing, said at least one volume control chamber being located in the vicinity of said discharge port;

first port means communicating said at least one volume control chamber with said pumping chamber;

second port means communicating said at least one volume control chamber with said suction port;

a valve received within each of said at least one volume control chambers; and control means coupled to and controlling said valve such that said valve selectively assumes any one of first, second and third predetermined positions in its respective volume control chamber irrespective of a driving state of said pressurizing member;

wherein said valve at said first position thereof is disposed to close both said first port means and second port means so that said pressurizing member performs a compression action with a normal compression ratio, said valve at said second position thereof being disposed to open said first port means and close said second port means to increase by a substantial amount the compression volume of said pumping chamber, whereby said pressurizing member performs a compression action with a reduced compression ratio and a consequently reduced discharge flow rate, and said valve at said third position thereof being designed to open both said first port means and said second port means so that no compression action is performed by said pressurizing member.

2. The compressor as claimed in claim 1, wherein said valve comprises a rotary valve.

3. The compressor as claimed in claim 1, wherein said valve comprises a spool valve.

4. The compressor as claimed in claim 1 or 2, wherein said gas pressurizing member comprises a rotor rotatably received within said internal space, said internal space having inner peripheral surfaces so configurated as to define said pumping chamber in cooperation with said rotor during rotation of said rotor.

5. The compressor as claimed in any one of claims 1 2 or 3, wherein said gas pressurizing member comprises a piston received within said internal space for reciprocating motion therein, said internal space comprising a cylinder bore which defines said pumping chamber in cooperation with said piston during reciprocating motion of said piston.

6. The compressor as claimed in claim 3, wherein said gas pressurizing member comprises a rotor rotatably received within said internal space, said internal space having inner peripheral surfaces so configurated as to define said pumping chamber in cooperation with said rotor during rotation of said rotor.

* * * * *

UNITED STATES PATENT AND TRADEMARK OFFICE

CERTIFICATE OF CORRECTION

PATENT NO. : 4,410,299

DATED : October 18, 1983

INVENTOR(S) : Konoshuke SHIMOYAMA

It is certified that error appears in the above-identified patent and that said Letters Patent is hereby corrected as shown below:

Column 6, line 8 (claim 1), change "moving" to read --movement--;

Column 6, line 56 (claim 5), after "claims 1", insert -- , --.

Signed and Sealed this

Seventh Day of February 1984

[SEAL]

*Attest:*

GERALD J. MOSSINGHOFF

*Attesting Officer*

*Commissioner of Patents and Trademarks*